US011745373B2

(12) United States Patent
Jenter

(10) Patent No.: US 11,745,373 B2
(45) Date of Patent: Sep. 5, 2023

(54) METHOD AND CUTTING MACHINE WITH SAFETY-MONITORED REVERSING OF THE DANGEROUS CUTTING BLADE MOVEMENT IN THE EVENT OF DANGER

(71) Applicant: Krug & Priester GmbH & Co. KG, Balingen (DE)

(72) Inventor: Holger Jenter, Balingen (DE)

(73) Assignee: Krug & Priester GmbH & Co. KG, Balingen (DE)

( * ) Notice: Subject to any disclaimer, the term of this patent is extended or adjusted under 35 U.S.C. 154(b) by 0 days.

(21) Appl. No.: 17/654,588

(22) Filed: Mar. 12, 2022

(65) Prior Publication Data

US 2022/0297327 A1 Sep. 22, 2022

(30) Foreign Application Priority Data

Mar. 17, 2021 (EP) ..... 21163050

(51) Int. Cl.
*B26D 1/08* (2006.01)
*B26D 5/08* (2006.01)
*B26D 7/22* (2006.01)

(52) U.S. Cl.
CPC ..... *B26D 1/08* (2013.01); *B26D 5/086* (2013.01); *B26D 7/22* (2013.01)

(58) Field of Classification Search
CPC .. B26D 1/08; B26D 5/086; B26D 7/02; F16P 3/144; F16P 3/147
See application file for complete search history.

(56) References Cited

U.S. PATENT DOCUMENTS 3,560,800 A * 2/1971 Weidenfeld ..... F16P 3/20 361/189
5,488,886 A * 2/1996 Mohr ..... B26D 7/025 83/29
5,880,954 A * 3/1999 Thomson ..... F16P 3/144 700/111
7,976,001 B2 * 7/2011 Ishii ..... B26D 7/025 270/52.17

(Continued)

FOREIGN PATENT DOCUMENTS

CN 107803858 A * 3/2018 ..... B26D 1/08
CN 110281289 A * 9/2019 ..... B26D 1/08

(Continued)

*Primary Examiner* — Jonathan G Riley
(74) *Attorney, Agent, or Firm* — Orbit IP

(57) ABSTRACT

A method for the cutting of material is to be cut by means of a cutting machine which includes a horizontal cutting support for material to be cut, a horizontal cutting blade displaceable in height above the cutting support for cutting the material to be cut supported on the cutting support, a drive motor for the height displacement of the cutting blade, a manual control for the drive motor, and a protection device safeguarding the working region of the cutting machine. The method has the steps of: lowering the cutting blade, when the protection device is not interrupted, by actuating the manual control; and stopping the cutting blade which is being lowered when the protection device is interrupted. Immediately after stopping the cutting blade which is being lowered, the drive motor is operated to reverse the cutting blade under safety monitoring into a nondangerous upper safety location.

16 Claims, 1 Drawing Sheet

(56) References Cited

U.S. PATENT DOCUMENTS

| | | | | |
|---|---|---|---|---|
| 2002/0034428 | A1* | 3/2002 | Marsh | B26D 7/015 412/9 |
| 2006/0123969 | A1* | 6/2006 | Fujita | B26D 7/025 83/697 |
| 2007/0033982 | A1* | 2/2007 | Denkmeier | B21D 55/00 72/429 |
| 2018/0328537 | A1* | 11/2018 | Hufnagel | F16P 3/144 |
| 2021/0308891 | A1* | 10/2021 | Oudsen | B26D 7/0006 |
| 2021/0323185 | A1* | 10/2021 | Oudsen | B26D 5/086 |

FOREIGN PATENT DOCUMENTS

| | | | | | |
|---|---|---|---|---|---|
| CN | 210574037 | U | * | 5/2020 | |
| CN | 111730682 | A | * | 10/2020 | B26D 7/22 |
| DE | 19516953 | A1 | * | 11/1996 | B26D 1/08 |
| EP | 0035522 | B1 | * | 11/1986 | |
| EP | 0 723 841 | A1 | | 7/1996 | |
| EP | 0789182 | A1 | * | 8/1997 | |
| EP | 1515078 | A2 | * | 3/2005 | F16P 3/144 |
| EP | 2 591 897 | A1 | | 5/2013 | |
| JP | 2014213407 | A | * | 11/2014 | |

* cited by examiner

METHOD AND CUTTING MACHINE WITH SAFETY-MONITORED REVERSING OF THE DANGEROUS CUTTING BLADE MOVEMENT IN THE EVENT OF DANGER

CROSS-REFERENCE TO RELATED APPLICATIONS

This application claims priority to European Application No. 21 163 050.4, filed Mar. 17, 2021, the entire contents of which are hereby incorporated in full by this reference.

DESCRIPTION

Field of the Invention

The invention relates to a method for the cutting of material to be cut by means of a cutting machine which comprises a horizontal cutting support for material to be cut (for example a stack of paper), a horizontal cutting blade displaceable in height above the cutting support for cutting the material to be cut supported on the cutting support, a drive motor for the height displacement of the cutting blade, a manual control, in particular a two-hand control, which switches the drive motor, and a protection device (safety sensors, for example photoelectric barriers, or a mechanical protection device) safeguarding the working region of the cutting machine, having the following method steps: lowering the cutting blade, when the protection device is not interrupted, by actuating the manual control, and stopping the cutting blade which is being lowered when the protection device is interrupted.

Background of the Invention

Such a method and an associated cutting machine are widely known in the prior art.

There are currently various functional principles in electrically driven cutting machines both for the pressing of material to be cut and for the cutting blade drive. These may in part be assigned to particular machine size groups, since in that case they represent the respectively best compromise of function and costs.

The smaller cutting machines occupy a certain special place since the necessary forces for actuating the pressing of material to be cut are not so high in comparison with larger machines that the operator's muscle power is often sufficient and motorized assistance is not necessary. These machines are often not production machines with which the operator works all day long. Such machines have a typical application, for example, in copy shops. The partial or full electrification is in this case often used primarily for increased convenience, since the operator's exertion of force is reduced and it is also constantly possible to work faster. Since the small-machine sector is particularly price-sensitive, the production costs for the respective functional principle are given priority in this case and must not become too high in relation to the manual machine variant. Only simple systems are therefore generally used for the electrification in this case, and sometimes only the blade drive is motor-driven. If the device for the pressing of material to be cut is likewise driven by motor, the pressing force is generally not adjustable.

Cutting machines of the medium machine group size have a very widespread use, ranging from the professional copy shop through in-house printing shops to the professional printing shop. These machines are particularly suitable for smaller and medium paper formats which are often used in the digital printing method. For this reason, this medium machine size group has increased in market importance and required professionalism. The market is in this case increasingly requiring equipment features and working speeds which have previously been reserved primarily for machines of the large machine size group. The equipment features, however, usually cannot be achieved in the medium machine group segment by the techniques of the large machine group size. Reasons for this are for example the overall size, the complexity and the price for producing the equipment features. It should be possible for machines of the medium machine group size to be run on the standardly fused single-phase supply, since this is available almost at all desired places of use. The energy efficiency of such machines is important for several reasons. One reason is that the required energy consumption should be kept as low as possible with a view to environmental protection and operating costs, as for all electrically powered apparatuses. A further reason is that the single-phase household electrical installation which is desirably used limits the possible power consumption and therefore the performance of the machine. This means that the more energy-efficiently the machine operates, the greater the power which can productively be used for the actual machine function.

The large machine group size comprises machines which are developed primarily for large formats of material to be cut and almost exclusively for professional users. In this case, there are many machine equipment features which are desired or required by the operator, often even customer-specific adaptations. The machines of this class are traditionally suitable for companies which, for example, process printed matter with high print runs in large formats, which are printed in offset printing machines. The production costs and the associated retail price for such machines are also correspondingly high. The price, but also the network supply to be provided for the often high required power rating, are not suitable for the needs and capabilities of the users who process smaller formats and print runs, often in the field of digital printing.

In what follows, the focus is primarily on the medium machine group size, wherein the technical comments may naturally also be applied for the small and large machine group size.

In principle, the actual pressing/cutting cycle always takes place in the same way. The operator places the material to be cut on the machine table and positions it under the blade, which is located above the material to be cut in its safe starting position. In this safe starting position, the blade edge is generally covered by the clamping bar, which protrudes it downwardly in its starting position. The clamping bar is located directly behind the blade and therefore in its starting position prevents the operator being capable of being injured on the blade edge in this blade/clamping bar position. Since large forces and very sharp blades are sometimes needed for cutting the material to be cut and high pressure forces are also sometimes required for fixing the material to be cut, it is necessary to ensure by means of correspondingly monitored protection devices that the operator cannot be injured. Such protection devices may on the one hand be mechanical protection devices, which may for example consist of metal or plastic. The protection devices may be fastened in fixed or mobile fashion on the machine, in so far as this is necessary for loading and unloading the material to be cut. Such mobile protection devices must be monitored correspondingly reliably on the machine side in order to ensure that a pressing/cutting cycle can be started only when they are properly closed. On the other hand, the necessary access for the operator may also be achieved with optoelectronic safety light curtains which monitor the danger region by means of optical sensors and allow cutting to be initiated only when the light curtain is not interrupted by objects or body parts. In addition, the pressing/cutting cycle can often be initiated only by means of a two-hand switch so that the operator's hands are fixed in position on the operating elements when initiating the cycle and therefore the dangerous machine movement. The arrangement of the operating elements is configured in such a way that an actuation by means of only one hand or by means of aids is not possible, or at least made as difficult as possible. The pressing/cutting cycle stops as soon as the operator releases at least one of the operating elements, but at the latest after a cycle has been completely executed and the clamping bar and the blade have therefore returned to the safe starting position (reset control). Each cycle must be initiated individually by both operating elements being actuated simultaneously within 0.5 seconds (simultaneity condition). The operating elements must be released between the cycles. The configuration of the safety devices and the monitoring of their various operating states are subject to strict normative rules which ensure maximum operating safety.

In addition to the operating safety, however, from the operator's viewpoint, the operating convenience and the working speed are naturally also very important, so that flexible, maximally efficient and ergonomic work is possible. The cutting machine should thus be adapted or adaptable optimally to the operator's requirements and at the same time offer the maximum performance in the scope of the technical possibilities which can be provided with the predetermined, standardly fused single-phase supply while complying with all safety rules. If all the aforementioned points are to be implemented optimally, this has hitherto been possible only limitedly or entails overall production costs which have previously been reserved for the large machine group size.

As already mentioned above, the necessary safety, control and drive concept for cutting machines is of elementary importance. Manufacturers must assess the risk of a product in the scope of the machine guideline in order to protect persons who come into contact with the machine. The aim in this case is always to minimize the danger to the extent that there is a tolerable residual risk. In this case, a three-stage process is generally adopted:

$1^{st}$ stage: avoid risks as far as possible by design;

$2^{nd}$ stage: reduce remaining risks by technical protection measures;

$3^{rd}$ stage: describe residual risks and handling recommendations for the appropriate procedure by compiling user information such as operating and setup instructions.

The notion of machine safety relates mostly to the $2^{nd}$ stage. The way in which, however, the technical protection measures have to be configured is not, however, usually specified exactly. For this reason, the following three safety concepts have been established, respectively with specific advantages and disadvantages.

In central, contact-based safety systems with safety relays, the conventional automation of safety functions is originally based on safe relay technology. This is also now used inter alia in cutting machines as well. The logic is in this case represented by means of hard-wired contacts, which are often positively driven. The advantage of these installations is that they can be implemented relatively economically in terms of component parts and owing to the low complexity can be used and repaired worldwide. Software is not employed in this case. Its use is currently restricted usually to machines with only a low complexity, such as are often to be encountered in the small machine group size. For machines with more complex safety tasks, such as typically occur in the medium, but also in the large machine group size, however, the relay technology very quickly becomes confusing. Searching for and diagnosing faults are very expensive, and self-testing of the system is not possible, or is possible only with great difficulty.

Beyond a certain complexity level, it is more sensible and more favourable to produce centrally wired applications with safety controllers or programmable logic controllers (PLCs). Programs which link actions with conditions and Boolean operations (AND, OR, NOT, XOR) can be written into controllers or safety controllers. Although the wiring is simpler than in relay technology, all the safety-related signals must be sent to the central controller, which is usually located in a switchgear cabinet. This generally entails long assembly or setting up times, which in turn leads to increased costs. Advantages of the safety controllers are, however, that already created safety programs can be copied and used multiply for machines of the same type, and extensions to the safety functions are quite straightforwardly possible. Furthermore, the safety applications may be represented graphically on HMIs (human machine interfaces), and all information such as settings and states, etc., which the machine provides may be conveniently retrieved at any time. Information and signals travel both from the controller to the PLC and from the PLC to the controller. The operators also carry out the programming of the control application with the aid of a graphical interface and prefabricated modules for conventional safety components by a copying function (drag and drop), without programming code. Usually, a simulation functionality as well as various data export possibilities for the future documentation are also integrated. Programs may be copied and also transferred to other controllers using mobile data media such as USB sticks. In this way, many of the safety programs may be developed and tested off-line, i.e. without a cutting machine, on the PC and subsequently loaded onto the application in the cutting machine. The actual wiring must be carried out in situ on the machine by means of conventional point-to-point connections. The elaborate wiring during setting up, especially for larger and more complex machines, is often one of the great disadvantages of the central safety architecture. One intermediate solution may then be local protection compartments in which the controllers are installed decentrally. Especially for concatenated systems or messages, the bus cycle times need to be taken into account. In this case, longer reaction times need then possibly to be calculated in. The longer reaction times of the controller mean in the cutting machine that a longer reaction time elapses between the identification of a dangerous situation, for example the entry of the operator into the protection region of the pressing/cutting functional unit while the latter is moving dangerously, and the necessary reaction of the machine, in this case immediately ending the dangerous movement. As a consequence, the corresponding protection devices need to be fitted further away from the source of danger so that the operator is not endangered. Often, this is technically not possible or at least not desired, since the cutting machine thereby usually increases in its external dimensions and work is made more difficult, or is no longer ergonomically possible.

In order to minimize the construction of protection housings centrally or decentrally and in order to be able to wire machines and put them into operation rapidly, decentral safety installations are available, which may also, if necessary, be obtained with high IP protection levels. As in automation technology, decentral architectures are also becoming increasingly widespread in safety technology. Distinction is in this case to be made between two types, namely on the one hand decentral concepts which collect secure signals on I/O modules and bring them to the central safety controller by means of field buses or secure ethernet protocols, and on the other hand fully decentralized installations which control safety applications directly in the field on safety controllers. Which alternative is more suitable is respectively determined in the individual case. Both decentral architectures offer the advantage of efficient, singular wiring by ethernet lines and standard plug connectors. The high information density and the possibility of communicating meta-information facilitate both setting up and diagnosis. All signals, safety-related as well as operational, from diverse sensors travel via an interface. One variant of the decentral safety concept is the so-called passive safety. These applications are comparatively economical and offer a combination of the advantages of central and decentral safety architectures. In contrast to conventional safety technology, passive safety applications do not supply each actuator by a separate secure signal output. The passive safety merely ensures that the voltage of an actuator group is turned off securely in critical situations, that is to say ones which endanger the operator. To this end, the I/O groups used consequently DC-isolate the sensor voltage from the actuator voltage. The actuators of the machine, in the present case the drive of the pressing/cutting unit, are turned off independently of their current state.

SUMMARY OF THE INVENTION

The object of the present invention is to further increase the safety in a method of the type mentioned in the introduction, and to provide an associated cutting machine.

This object is achieved according to the invention in that immediately after stopping the cutting blade which is being lowered, the drive motor is operated to displace ("reverse") the cutting blade under safety monitoring into a nondangerous upper safety location.

So that the blade edge does not remain open during an intervention in the safety region or an incompletely executed cutting cycle and secondary injuries to the operator are therefore avoided, according to the invention the drive motor returns the cutting blade into the upper safety location, which does not represent a dangerous movement. In comparison with usual controllers on the market, according to the invention whether the cutting blade is actually moving upwards after the stopping is also monitored. In the event of danger, i.e. for example in the event of a dangerous downward movement of the cutting blade, the displacement movement of the cutting blade is securely stopped. A height-displaceable clamping bar for pressing down the material to be cut, which covers the blade edge in the upper safety location, may be arranged behind the cutting blade.

Preferably, the safety monitoring comprises the determination of the actual displacement direction of the cutting blade or the rotation direction of the drive motor and, if a downward movement of the cutting blade is established, the secure stopping of the drive motor. The rotation direction reversal with rotation direction monitoring (reversing the blade displacement direction during intervention of the operator in the monitored safety region) represents a much more sophisticated safety function than currently just initiating an emergency stop or turn-off of the motor torque (STO).

The safety monitoring may be carried out in different ways, for example optically by means of photoelectric barrier monitoring along the cutting blade displacement path or else by means of a rotary encoder on the motor shaft. Particularly preferably, the actual displacement direction of the cutting blade is determined with the aid of a rotary field of the phase currents applied to the drive motor. If a downward movement of the cutting blade is established with the aid of the rotary field, the rotary field generating the torque-forming currents is turned off, whereby the drive motor stops. Advantageously, the actual displacement direction of the blade is evaluated for the displacement direction monitoring only after a reversing time (for example 180 ms), required for the direction reverse of the motor driving, following the stopping of the cutting blade which is being lowered.

In a preferred method variant, it is provided that the rotary field of the phase currents applied to the drive motor is generated by at least a first of at least two mutually monitoring processors by means of control signals, in particular PWM signals, that the phase currents actually applied to the drive motor are registered by the two processors and that, in order to stop the drive motor, at least one, preferably both processors interrupt at least some of the control signals or no longer vary them as a function of time. If the rotary field indicates a downward movement of the cutting blade, cutting of the control signals may be triggered by both processors independently of one another. The drive motor therefore no longer sustains a torque, and the blade drive is in a safe state.

Advantageously, simultaneously with the stopping of the cutting blade which is being lowered, a mechanical brake may be operated to brake the drive motor to a rest and block it, unless this operation is negated within the activation time of the brake by establishing that the actual displacement direction of the cutting blade is directed upwards.

In a further aspect, the invention also relates to a cutting machine comprising a horizontal cutting support for material to be cut, a horizontal blade displaceable in height above the cutting support for cutting the material to be cut supported on the cutting support, a drive motor for the height displacement of the blade, a manual control, in particular a two-hand control, switching the drive motor, a protection device safeguarding the working region of the cutting machine, and a machine drive controller which controls the cutting process and is programmed to operate the drive motor according to the method described above.

Particularly preferably, the drive motor is a polyphase motor and the machine drive controller comprises at least one processor (microcontroller) which outputs the control signals, in particular pulse width modulation (PWM) signals, required for generating the phase currents of a rotary field for the drive motor and registers the phase currents actually applied to the drive motor, and in order to stop the drive motor interrupts at least some of the control signals or no longer varies them as a function of time.

Advantageously, the machine drive controller may comprise two mutually monitoring processors, at least one of the two processors generating the control signals, in particular PWM signals, both processors registering the phase currents actually applied to the drive motor and at least one of the two processors, preferably both processors, in order to stop the drive motor, interrupting at least some of the control signals or no longer varying them as a function of time.

Preferably, at least one processor comprises a monitoring unit which determines the actual displacement direction of the blade with the aid of the registered phase currents of the drive motor and stops the drive motor if a downward movement of the cutting blade is established. A power driver (output stage), which generates the phase currents for the drive motor with the aid of the control signals, in particular PWM signals, of the processor, may be arranged downstream of the at least one processor. Particularly preferably, the signal lines of the control signals respectively comprise a switch, in particular an optocoupler, operated by the at least one processor for connecting through or interrupting the signal lines. Preferably, all signal-relevant inputs and outputs of the at least one processor are safeguarded by means of DC isolation, in particular by means of optocouplers.

In one particularly preferred embodiment, the machine drive controller is formed by a frequency converter with functional as well as safety-oriented control. In this way, on the one hand, a required performance level "e" (PLe) may be achieved without resorting to a combination of expensive standard individual systems, and on the other hand the special safety and functional needs of a cutting machine may be taken into account. By means of the frequency converter, a cutting machine drive motor may be regulated in a desired way. With the frequency converters standardly available on the market, without additional safety elements it is only possible to achieve a maximum performance level "d" (PLd). The performance level is a measure of the reliability of a safety function and in this case describes the level of the contribution to the risk reduction of individual component parts or safety function. It is denoted by PL for performance level and a letter "a" to "e", where "e" stands for the greatest risk reduction and reliability. For cutting machines of the type described, a performance level PLe is prescribed, which is achieved with the frequency converter according to the invention without other necessary, additional, external safety elements.

Since, as already described above, the cutting machines of the small and medium machine group size are desired by customers preferably to be operated on the standard single-phase household installation, the maximum electrical machine power is limited. It is therefore even more important that the maximum available electrical power can be used as effectively as possible when needed and the cutting machine can in addition also be adjusted automatically or manually within predetermined limits to different household installation fuse ratings and supply voltage fluctuations and dips. To this end, it is necessary that the drive motor can be regulated in such a way that it does not draw high peak currents from the supply, such as typically occur during start-up and when blocking unregulated capacitor motors. Although these peak currents possibly only occur briefly (start-up current), they may already lead to the tripping of the household installation fuse. Such a motor/controller combination could only be configured in such a way that the drive motor would have to remain below its capabilities at the actual operating point because of its start-up current. As is generally usual in the case of conventional frequency converters, with the frequency converter according to the invention it is also possible to smoothly regulate the drive motor with functional as well as safety-related control during start-up, so that high peak currents do not occur. The drive motor may therefore be regulated in each operating state in such a way that a predetermined adjustable maximum current or a maximum power are not exceeded. If the factory-set maximum current/power value cannot be provided by the respective household installation for the respective operator, this is recognized and the operator is allowed to adapt the value to their requirements by means of the HMI. Voltage dips under load, which may occur in unstable electrical networks because of the power needed during the pressing/cutting cycle, are also recognized by the machine and compensated for by regulating technology. The compensation is carried out by reducing the driving frequency for the three-phase motor, which drives the cutting machine, automatically within defined and sensible limits until the motor torque needed for the pressing/cutting cycle can be provided. In a similar way to the driving frequency, the rotational speed of the drive motor and therefore the displacement speed of the cutting blade and of the clamping bar during the pressing/cutting cycle are also reduced. The customer may therefore use their individually available household installation power optimally and work with the maximum possible speed, without the cutting machine already having to be "electrically throttled" at the factory in such a way that it is capable of running even under poor supply connection conditions or would no longer be capable at all of carrying out a complete cut in comparison with unregulated machines.

In addition to the aforementioned intelligent supply adaptation capability, which when required leads to a correspondingly adapted speed of the pressing/cutting cycle, the machine controller may also control the motor start-ups and the motor decelerations during the forward and backward running in all other possible operating states to the desired extent by means of the frequency converter with functional as well as safety-related control. Undesired overload peaks in the drive train, which occur for example due to blocking thereof, may therefore be detected and mitigated, and if required reported to the operator by means of the HMI.

One potentially dangerous activity, which is however always necessary in cutting machines of the type described, is the replacement of a blunt cutting blade with a sharp cutting blade. This is necessary after more or fewer pressing/cutting cycles, depending on the material to be cut and the requirement for the cutting outcome. For this purpose, the cutting blade needs to be removed from the cutting machine, generally with the aid of a blade replacement apparatus, and reinstalled after the replacement. The cutting machine may in this case assist the operator by a corresponding programmed blade replacement routine being stored in the machine controller, which is activated by the operator when required and displayed by means of the HMI. The cutting machine displaces the cutting blade, or the clamping bar, into the safe lower end location so that the operator is protected as well as possible from danger and injuries by the blade edge when replacing the cutting blade. After the blade replacement is completed, the function is exited by the operator. The cutting machine carries out the next pressing/cutting cycle initiated by the operator with a greatly reduced speed (figuring cycle) and with a strongly limited drive power, so that possible errors by the operator during the blade replacement, such as an incorrect depth setting of the cutting blade or forgotten tool in the working region, cannot lead to the hard blocking event with possible damage to the cutting blade or other machine parts.

In order to be able to make the cutting machine as economical and compact as possible, it makes sense to configure the installed modules in such a way that they are thermally optimized for the average load profile of the operator and the average ambient conditions. At the same time, however, it is necessary to ensure that the cutting machine does not suffer any damage even during operation outside the standard conditions of use in respect of load profile and ambient temperatures, and in the optimal case is adjusted to the corresponding requirements. This is achieved, with the frequency converter according to the invention with functional as well as safety-oriented control, in that all temperature-critical modules, for example the drive motor, the power output stages, but also modules such as a hydraulic unit for the pressing process or a single-board computer are temperature-monitored. The corresponding temperature values are monitored in the frequency converter with functional as well as safety-oriented control. When reaching the preset temperature limit values of one or more monitored modules, the maximum speed is reduced by means of the regulating logic until continuous working without cooling interruptions is ensured. This is generally done in a scope which is not negatively perceived by the operator, and naturally only until the respective load situation again allows the operation of the machine with the optimal speed.

Owing to the fact that the frequency converter according to the invention with functional as well as safety-oriented control represents the central control and logic unit of the cutting machine, on which all information of the installed sensors and switches as well as also the inputs by the operator via the HMI come together, information may be prepared from the multiplicity of available data for the operator, or else also for possibly required service or repair interventions, and output via the HMI.

Furthermore preferably, the frequency converter output frequency for the drive motor, and therefore the motor rotation speed or the speed of the cutting cycle, may be adapted as a function of the respective voltage stability of the mains supply.

Further advantages of the invention are evident from the description and the drawing. Likewise, the features referred to above and those yet to be mentioned below may respectively be used according to the invention individually or jointly in any desired combinations. The embodiments shown and described are not to be understood as an exhaustive list, but rather have an exemplary nature for the presentation of the invention.

BRIEF DESCRIPTION OF THE DRAWINGS

The invention is represented in the drawings and will be explained in more detail with the aid of an exemplary embodiment, in which.

DETAILED DESCRIPTION OF THE PREFERRED EMBODIMENTS

Figure 1:
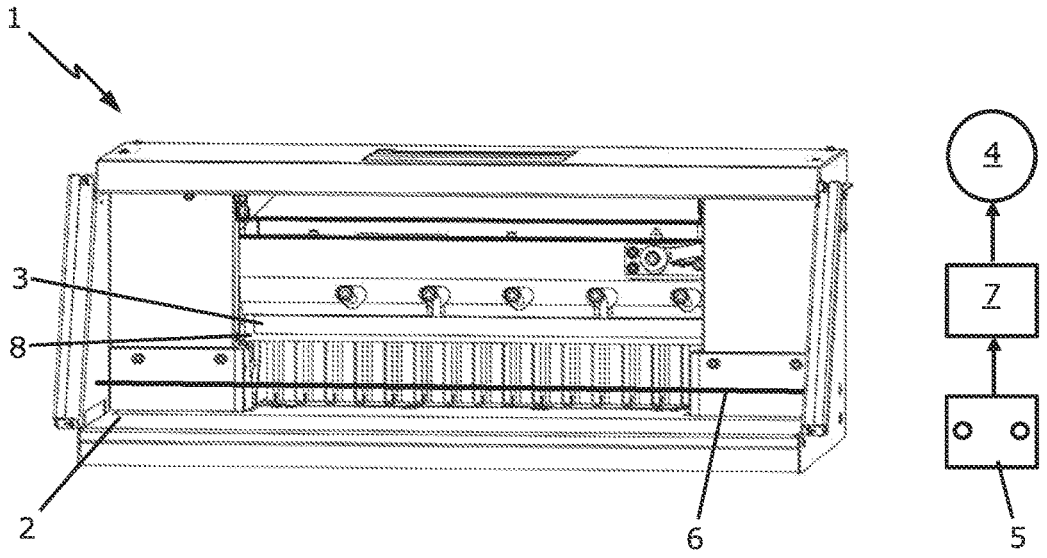
FIG. 1 shows a cutting machine according to the invention having a machine drive controller for the safety-monitored displacement of a height-displaceable cutting blade.

The cutting machine 1 shown in FIG. 1 comprises a horizontal cutting support 2 for material to be cut, a cutting blade 3 displaceable in height above the cutting support 2 for cutting the supported material to be cut, a drive motor 4 for the height displacement of the cutting blade 3, a manual control (for example a two-hand control) 5 for the drive motor 4, a protection device (configured here for example as a photoelectric barrier) 6 safeguarding the working region of the cutting machine 1, and a machine drive controller 7 controlling the cutting process. A height-displaceable clamping bar 8 for pressing down the material to be cut is also arranged behind the cutting blade 3, a pressing drive (not shown here) being manually actuated or electrically driven for the height displacement of the clamping bar 8. Preferably, the machine drive controller 7 is formed by a frequency converter with functional as well as safety-oriented control.

The operator places the material to be cut on the cutting support 2 and positions it under the cutting blade 3, which is located above the material to be cut in a safe upper starting position in which the blade edge is generally covered by the clamping bar 8. By actuation of the manual control 5 when the protection device 6 is not interrupted, the cutting blade 3 is lowered as far as the cutting support 2. If the protection device 6 is interrupted, the downward movement of the cutting blade 3 is stopped and immediately after this the cutting blade 3 is reversed under safety monitoring into the nondangerous upper starting position. The safety monitoring comprises the determination of the actual displacement direction of the cutting blade 3 and, if a downward movement of the cutting blade 3 is established, the stopping of the drive motor 4.

Figure 2:
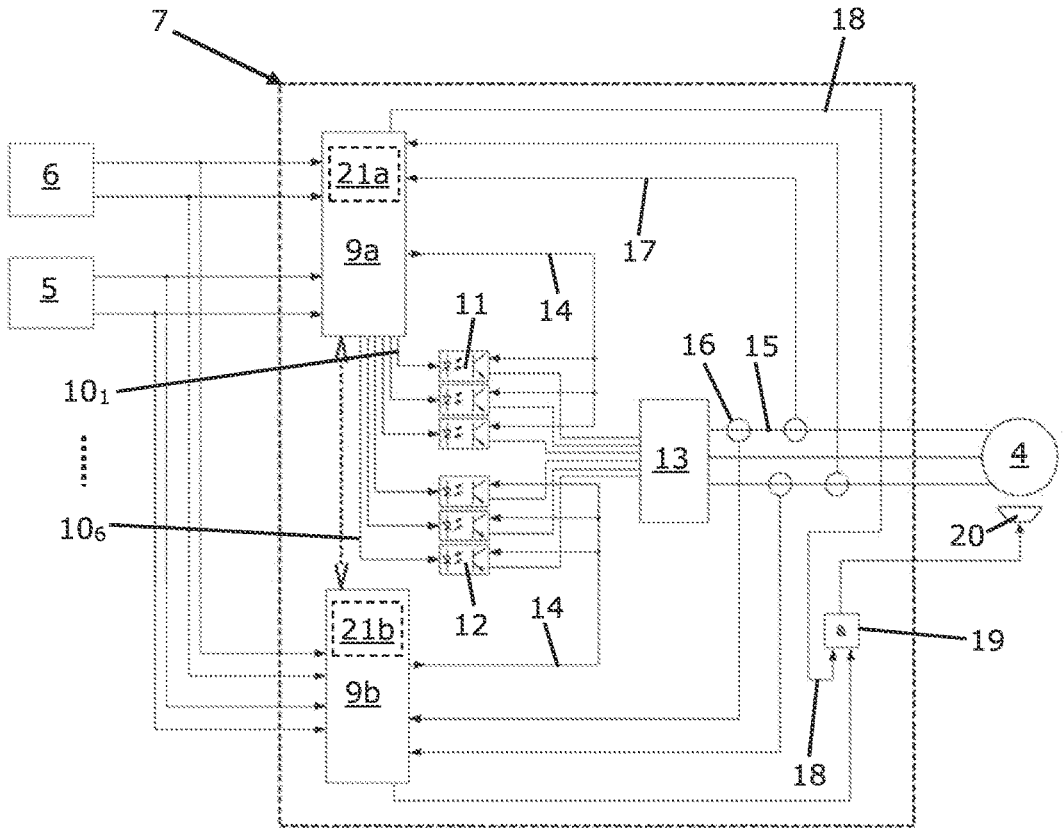
FIG. 2 shows a block diagram of a machine drive controller according to the invention.

FIG. 2 schematically shows a block diagram of the machine drive controller 7 for a drive motor 4 configured as a three-phase motor. The machine drive controller 7 comprises two processors (CPUs) 9*a*, 9*b* which monitor one another at the input and output signal level, as indicated by the dashed double arrow. The two processors 9*a*, 9*b* are both respectively connected to the hand control 5 and to the protection device 6.

The one, first processor 9*a* has the main task of regulating the drive motor 4 close to the tilting moment; the other, second processor 9*b* is a dedicated safety CPU with a monitoring function. All the safety functions are evaluated and monitored by the two processors 9*a*, 9*b*. Both processors 9*a*, 9*b* can initiate safety-relevant processes independently of one another.

The first processor 9*a* generates PWM control signals on six signal lines 101 to 106, which are connected to a power driver (output stage) 13 by means of three PWM-Hi optocouplers 11 and three PWM-Lo optocouplers 12. The PWM-Hi optocouplers 11 are driven by the first processor 9*a* and the PWM-Lo optocouplers 12 are driven by the second processor 9*b*, respectively via lines 14, in order either to connect through or interrupt the signal lines 101 to 106. The power driver 13 is connected to the drive motor 4 by means of three output lines 15 and generates three phase currents, which generate a rotary field for the drive motor 4, according to the PWM control signals. The phase currents actually applied to the drive motor 4 are at 16 tapped from two of the three output lines 15 and sent via lines 17 to the two processors 9*a*, 9*b*. Via lines 18, the two processors 9*a*, 9*b* together—by means of an AND gate 19—respectively operate a brake 20 in order to mechanically brake and block the drive motor 4.

All safety-relevant inputs and outputs of the two processors 9*a*, 9*b* are DC-isolated by means of optocouplers (not shown).

If an intervention is carried out in the protection device 6, the first processor 9*a* ends the downward movement of the cutting blade. So that the blade edge does not remain open and secondary injuries to the operator are therefore avoided, the machine drive controller 7 reverses so that the drive motor 4 returns the cutting blade 3 into the upper starting position.

As soon as the protection device 6 is interrupted, the rotary field is respectively monitored in a monitoring unit 21*a*, 21*b* of the two processors 9*a*, 9*b* (after the timer for the reversing has run down, 180 ms), by determining the actual displacement direction of the cutting blade 3 with the aid of the registered phase currents. If one of the two monitoring units 21*a*, 21*b* still establishes a downward movement of the cutting blade 3, or of the rotary field, with the aid of the registered phase currents after the reversing time has elapsed, the complex PWM pattern which is required for generating the rotary field is interrupted by at least one of the two processors 9*a*, 9*b* so that the drive motor 4 no longer sustains a torque and the blade drive is in a safe resting state. In order to interrupt the PWM pattern, the voltage of the three PWM-Hi optocouplers 11 is turned off by the first processor 9*a* or the voltage of the three PWM-Lo optocouplers 12 is turned off by the second processor 9*b*, which corresponds to the secure STO (Safe Torque Off) for the drive motor 4.

If the protection device 6 is interrupted, simultaneously with the stopping of the cutting blade 3 being lowered, the brake 20 is operated in order to brake the drive motor 4 to a rest and block it, unless this operation is negated within the activation time of the brake 20 by establishing that the actual displacement direction of the cutting blade 3 is directed upwards.

In comparison with usual controllers on the market, much more sophisticated safety functions are thus possible, such as the rotation direction reversal with rotation direction monitoring (reversing the pressing/blade displacement direction in the event of intervention by the operator in the safety region) instead of just an emergency stop or turning off the torque (STO). Latencies due to signal propagation times and longer reaction and slowing times resulting therefrom are minimized, whereby required safety margins from the danger location are reduced.

The cutting machine 1 according to the invention fulfils the following central requirement aspects:

- performance level e (PLe)—construction/functionality;
- maximum machine power even on differently fused single-phase household installations;
- intelligent, variable control of the cutting speed;
- operator assistance for safe blade replacement;
- regulation of the machine function as a function of the temperature of particular machine components;
- output of machine parameters and other information such as maintenance recommendations to the operator.

What is claimed is:

1. A method for the cutting of a material to be cut by a cutting machine comprising a horizontal cutting support for the material to be cut, a horizontal cutting blade displaceable in height above the cutting support for cutting the material to be cut supported on the cutting support, a drive motor for the height displacement of the cutting blade, a manual control for the drive motor, and a protection device safeguarding a working region of the cutting machine, the method comprising the following steps of:

lowering the cutting blade, when the protection device is not interrupted, by actuating the manual control;

stopping the cutting blade which is being lowered when the protection device is interrupted;

immediately after the stopping, operating the drive motor to reverse the cutting blade into a nondangerous upper safety location;

determining an actual displacement direction of the cutting blade, wherein the determining starts only after a reversing time, required for the direction reverse of the motor driving, following the stopping;

wherein the actual displacement direction of the cutting blade is determined with the aid of a rotary field of phase currents applied to the drive motor; and if a downward movement of the cutting blade is established during the reversing with the aid of the rotary field, turning off the rotary field generating torque-forming currents and stopping the drive motor.

2. The method according to claim 1, wherein the rotary field of the phase currents applied to the drive motor is generated by at least a first of at least two mutually monitoring processors by means of control signals, wherein the phase currents actually applied to the drive motor are registered by the two mutually monitoring processors, and wherein in order to stop the drive motor at least one or both of the two mutually monitoring processors interrupt at least some of the control signals or no longer vary them as a function of time.

3. The method according to claim 1, wherein simultaneously with the stopping of the cutting blade which is being lowered, a brake is operated to brake the drive motor to a rest and block it, unless this operation is negated within the activation time of the brake by establishing that the actual displacement direction of the cutting blade is directed upwards.

4. A cutting machine, comprising:

a horizontal cutting support for material to be cut;

a horizontal cutting blade displaceable in height above the cutting support for cutting the material to be cut supported on the cutting support;

a drive motor for the height displacement of the cutting blade; and a manual control for the drive motor;

a protection device safeguarding a working region of the cutting machine;

a machine drive controller which controls the cutting process and is programmed to operate the drive motor according to the following steps:

lowering the cutting blade, when the protection device is not interrupted, by actuating the manual control;

stopping the cutting blade which is being lowered when the protection device is interrupted;

immediately after the stopping, reversing the cutting blade into an upper safety location;

determining an actual displacement direction of the cutting blade, wherein the determining starts only after a reversing time, required for the direction reverse of the motor driving, following the stopping; and if a downward movement of the cutting blade is determined during the reversing, stopping the drive motor;

wherein the drive motor is a polyphase motor and the machine drive controller comprises at least one processor which outputs control signals, required for generating phase currents of a rotary field for the polyphase motor and registers the phase currents actually applied to the polyphasemotor and, in order to stop the polyphasemotor, interrupts at least some of the control signals or no longer varies them as a function of time.

5. The cutting machine according to claim 4, wherein the at least one processor of the machine drive controller comprises two mutually monitoring processors, at least one of the two mutually monitoring processors generating control signals, both of the two mutually monitoring processors registering phase currents actually applied to the drive motor and at least one of the two mutually monitoring processors or both of the two mutually monitoring processors, in order to stop the drive motor, interrupting at least some of the control signals or no longer varying them as a function of time.

6. The cutting machine according to claim 4, wherein the at least one processor comprises a monitoring unit which determines the actual displacement direction of the cutting blade with the aid of the registered phase currents of the drive motor and stops the drive motor if a downward movement of the cutting blade is established.

7. The cutting machine according to claim 4, wherein a power driver, which generates the phase currents for the drive motor with the aid of the control signals, of the processor, is arranged downstream of the at least one of the two processors.

8. The cutting machine according to claim 4, wherein the signal lines of the control signals respectively comprise a switch, operated by the at least one processor for connecting through or interrupting the signal line.

9. The cutting machine according to claim 4, wherein all signal-relevant inputs and outputs of the at least one processor are respectively safeguarded by means of DC isolation.

10. The cutting machine according to claim 4, wherein the machine drive controller is formed by a frequency converter with functional as well as safety-oriented control.

11. The cutting machine according to claim 4, including a brake, operated by the machine drive controller, for braking and blocking the drive motor.

12. The cutting machine according to claim 4, wherein the machine drive controller comprises two mutually monitoring processors, at least one of the two processors generating the control signals, both processors registering phase currents actually applied to the drive motor and at least one of the two processors or both processors, in order to stop the drive motor, interrupting at least some of the control signals or no longer varying them as a function of time.

13. The cutting machine according to claim 6, wherein a power driver, which generates the phase currents for the drive motor with the aid of the control signals, of the processor, is arranged downstream of the at least one processor.

14. The cutting machine according to claim 5, wherein signal lines of the control signals respectively comprise a switch, operated by the at least one of the two mutually monitoring processors for connecting through or interrupting the signal line.

15. The cutting machine according to claim 6, wherein signal lines of the control signals respectively comprise a switch, operated by the at least one processor for connecting through or interrupting the signal line.

16. The cutting machine according to claim 7, wherein signal lines of the control signals respectively comprise a switch, operated by the at least one processor for connecting through or interrupting the signal line.

* * * * *